United States Patent [19]

Thur et al.

[11] 4,257,745

[45] Mar. 24, 1981

[54] AUTOMATIC CONTROL SYSTEM FOR CENTRIFUGAL PUMPS

[75] Inventors: Gerry W. Thur, Alameda; Timothy A. Moore, Pleasanton, both of Calif.

[73] Assignee: Baltimore Aircoil Co., Jessup, Md.

[21] Appl. No.: 939,092

[22] Filed: Sep. 1, 1978

[51] Int. Cl.[3] ..... F04B 49/02; F04B 49/08

[52] U.S. Cl. ..... 417/18; 417/32

[58] Field of Search ..... 417/18, 32, 36, 38, 417/7, 12

[56] References Cited

U.S. PATENT DOCUMENTS

| | | | |
|---|---|---|---|
| 3,639,081 | 2/1972 | Gray et al. | 417/7 |
| 3,768,925 | 10/1973 | Klemm | 417/18 X |

OTHER PUBLICATIONS

Aurora Pump Catalog on APCO PM Booster System, May, 1977.

Prescon Pressure Control Unit Catalog.

Hydroservant I catalog of Red Jacket Pumps, Aug. 1977.

35M Series Minibooster System of Bell & Gossett catalog, 1975.

Jacuzzi Technical Bulletin No. JATB-1.

*Primary Examiner*—Carlton R. Croyle

*Assistant Examiner*—Edward Look

*Attorney, Agent, or Firm*—Michael C. Sudol, Jr.; Harry E. Westlake, Jr.

[57] ABSTRACT

The invention is a unique combination of a pressure switch, a temperature switch, and a check valve which act to automatically control the on-off operation of a centrifugal pump in response to an external flow demand.

2 Claims, 2 Drawing Figures

AUTOMATIC CONTROL SYSTEM FOR CENTRIFUGAL PUMPS

BACKGROUND OF THE INVENTION

Figure 1:
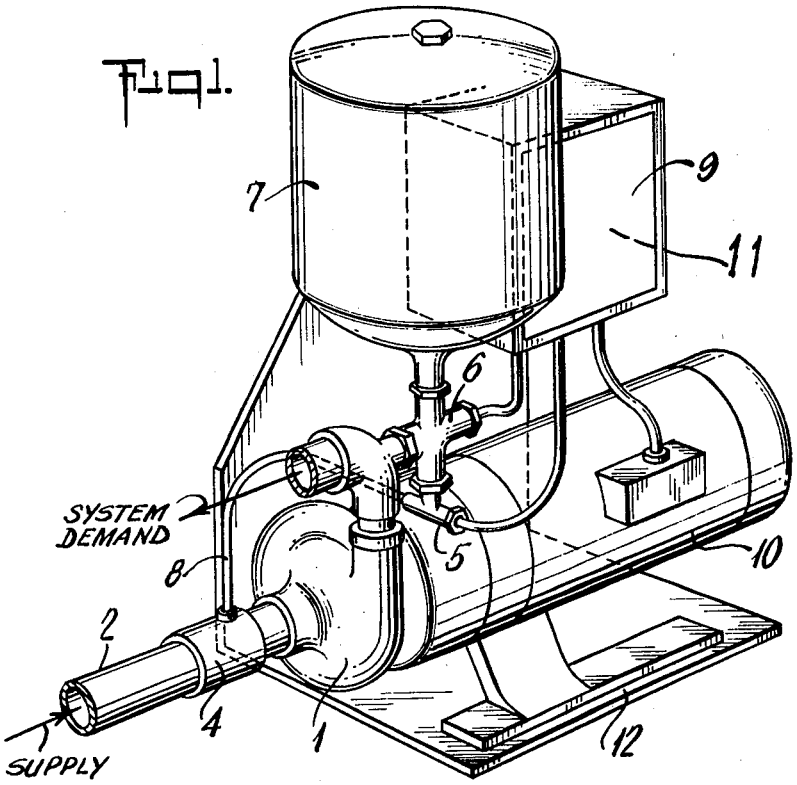

The problem of providing a simple, low cost, low capacity liquid (water) pressure booster system has been around for a long time. The simplest expedient is a continuously running centrifugal pump piped into the water supply line, and sized for the maximum flow-rate required. During periods of no demand for water, this approach suffers from boiling of the water within the pump volute, causing problems with pump seals, wear rings, and unsuspecting water users. An automatic "thermal purge" valve would solve this immediate problem, but adds water wastage to an already energy wasteful device.

A better method is to develop some way to automatically turn off the booster pump when it is not needed. A switch controlled by the system water pressure is an obvious choice. Whenever the system pressure is deficient, the pump is activated, and vice versa. This works well, except that the resulting continual start/stop cycles soon overheat and destroy the electric motor driving the pump.

This "short-cycling" problem has been eliminated to some extent by combining a hydropneumatic "accumulator" tank with the pressure control switch. The pressure "reservoir" thus provided can serve to lengthen the time the pump remains off by providing pressure for small demands on the system, provided a fairly large accumulator tank is used. In the past, absorption of the tank's air charge into the water was a serious problem, but today built-in flexible isolation bladders can be used to alleviate this problem. However, a serious drawback to the common pump/accumulator system is the bulk and expense involved with an adequately sized accumulator tank.

SUMMARY OF INVENTION

The invention is a unique combination of a pressure switch, a temperature switch, and a check valve which act to automatically control the on-off operation of a centrifugal pump in response to an external flow demand.

Thus, the invention is a unique combination of common elements which provides a low-cost means of automatic flow-demand based control for a centrifugal pump without inherent destructive short-cycling, with an inherent minimum run time feature, and with an inherent high supply pressure cut-out feature.

The invention is useful with all types of centrifugal pumps in intermittent flow-demand applications wherein the flow demand does not require liquid (in most practical operations water) at a temperature higher than 100° F. or lower than 32° F. It will control the on-off operation of the pump(s) in such a way as to reliably deactivate the pump(s) during extended periods of no demand for flow, and reactivate them for the duration of renewed flow-demand periods without destructive intervening on-off cycles.

Intermittent flow-demand applications are common in many types of pumping systems, such as, for example, in high rise apartment complexes, commercial buildings and the like.

Applicants' invention is made up entirely of conventional, off-the-shelf components. Thus, in addition to the close-coupled horizontal end-suction pump, the control system is comprised of a pressure switch, a temperature switch, an electrical contactor and a suction check valve and possibly a small accumulator tank. These control components represent about $80 total cost for a typical two horsepower unit.

The system functions as follows:

As in conventional pressure booster systems initial demand for water results in a falling system pressure which activates the pump via a simple pressure switch.

Unlike conventional accumulator systems, the pump is not de-energized by the rising system pressure. Instead, it runs until a zero or very low-flow condition has been present for approximately eight minutes. This condition is sensed by a small temperature switch which monitors the rising temperature of the liquid trapped within the volute during the periods of no demand for water.

The pump will only restart in response to a falling system pressure, regardless of temperature conditions.

A small accumulator tank may be used to smooth start and stop pressure variations, and by strategic positioning of the accumulator tank near the temperature switch, eliminates a hot start-up problem which would otherwise exist. The electrical contactor is a necessary part of the control circuitry, and in any case, is necessary for larger than fractional horsepower motors.

In summary, this automatic control system for centrifugal pumps provides reliable service, running only under flow demand combined with conditions of inadequate supply pressure. It is immune to short-cycling problems, without the cost and bulk of conventional accumulator systems. There is no thermal purge valve, and no accompanying water wastage. It is constructed entirely of low-cost, off-the-shelf components, with no special valve machining.

In order to better describe the operation of the pressure-thermal control system for centrifugal pumps, the following figures are presented:

FIG. 1 an isometric view of the pressure thermal system for centrifugal pumps; of our invention.

Figure 2:
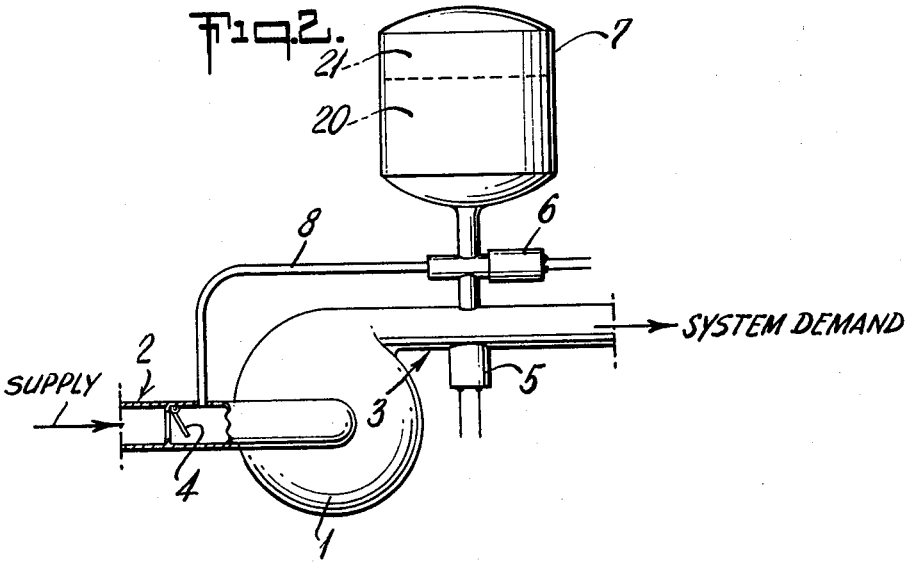

FIG. 2 a front schematic view of a typical thermal control system for centrifugal pumps of our invention.

Referring now to FIGS. 1 and 2 there is included a centrifugal pump 1 having an inlet section 2 and an outlet section 3. The outlet section 3 is connected to the system to which water or the liquid to be pumped is to be supplied. A check valve 4 is located in the inlet end of said pump 2. A temperature switch 6 is located in the flow path of a recirculation line 8, one end of the recirculation line being connected to the inlet end 2 of said pump between the check valve 4 and the pump 1 itself and the other end being located in the outlet end of said pump 3 so as to insure a small amount of flow past or in contact with the temperature switch 6. A pressure switch 5 is also located in the outlet end of said pump 3. Additionally, a pressure accumulator tank 7 is located on the outlet end 3 of said pump system adjacent or in the vicinity of the temperature switch 6, but at such position in the system so that liquid accumulated therein must flow past the temperature switch 6.

Referring now to FIG. 1, the pump 1 is driven by a motor 10 which motor is activated by the electrical panel 9.

The pressure switch 5, temperature switch 6 and pump motor switch 11 are controlled electrically and are integrated into a typical control circuit contained within a panel shown as panel 9 in FIG. 1 but whose operation and circuit diagram are not shown. The control circuit to control the operation of the pressure-thermal control system for centrifugal pumps as described in our invention is a type standard in the art and it would be known by any one skilled in the art how to construct such an electrical control system. This system does not represent part of this invention.

The entire pressure thermal control system but particularly the pump 1 and motor 10 are mounted for convenience on a base 12. The operation of the system is as follows:

An initial system flow demand is sensed by the resultant falling system pressure by the conventional pressure switch 5. The closure of this pressure switch in the control circuit acts to activate the pump motor 10 through the pump electrical switch. Thus being in an activated state, the system supplies the flow demand until such time as a zero or minimal flow condition occurs such as when there is no flow demand on the system. The pump which is running at zero or minimal flow inherently dissipates mechanical energy into the contained liquid in the form of heat. This condition then causes the liquid contained within the pump 1 to rise in temperature to a predetermined level. This temperature level is sensed by the temperature switch 6 suitably located in the recirculation path 8 of pump 1 which then acts in the control circuit shown in panel 9 to deactivate or shut-off the pump motor 10. The check valve 4 functions to prevent flow of liquid back through the inlet 2 when the pressure in the pump 1 and accumulation tank is greater than the liquid supply pressure. The system will not turn on again until a new system flow demand causes a new activation of the pump 1 via pressure switch 5.

A particular feature of the invention is that it prevents a "hot start-up malfunction" which would otherwise occur in the event of a new system flow demand occurring immediately following the deactivation of the pump 1 by the temperature switch 6. Ordinarily what would happen in the "hot start-up" would be that the new system demand would cause the pressure switch to turn on the pump 1 but it would immediately be turned off by temperature switch 6 because the liquid in the pump outlet would still be at a high enough temperature so that temperature switch 6 would tend to deactivate the pump 1. The "hot start-up" malfunction is prevented in the invention by situating a pressure accumulator tank 7 such that the initial flow demand causes a small flow of relatively cool liquid from the pressure accumulator tank 7 to be directed at the temperature switch 6 thus cooling it below its reset point before the flow demand is sensed by the pressure switch 5. The pressure accumulator tank 7 is merely a small tank which acts as a hydraulic energy storage device typically by causing the entering liquid 20 to compress a contained gas generally air 21 which then serves to force the liquid 20 out of the tank as required. This principle insures that the pump 1 will be activated by any new system flow demand regardless of previous control cycles.

A second method for insuring rapid cooling of the temperature switch under "hot start-up" conditions, involves repositioning the temperature switch at the suction inlet of the pump where relatively cool incoming supply liquid serves to quickly cool the temperature switch while the pump runs for a short initial period under the action of a time-delay relay in the control circuit.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

What is claimed is:

1. A pressure-thermal control system regulating the on-off operation of a liquid centrifugal pump in response to external flow demand which comprises in a closed loop arrangement:

a. a centrifugal pump having an inlet and outlet therein;

b. a check valve at the inlet side of said pump;

c. a pressure switch located at the outlet, said switch being sensitive to a preset low pressure in the pump outlet to turn on the centrifugal pump;

d. a temperature-sensitive switch located at the outlet to sense the internal liquid temperature of said pump, set to a preset temperature to turn the centrifugal pump off;

e. a pressure accumulator tank located at the outlet of said pump directly above the temperature switch;

f. a recirculation line connecting the inlet with the outlet of said pump; one end of said recirculation line located immediately adjacent to the outlet of said pump and the other end of said recirculation line located between the check valve and inlet of said pump, said recirculation line consisting of said temperature switch and said accumulator tank, both said temperature switch and accumulator tank located immediately adjacent to the outlet of said pump with the accumulator tank located directly above said temperature switch;

such that in operation when the temperature of the liquid in the pump and recirculation line rises and reaches the preset temperature, the temperature switch opens, causing pump shut-off and any new system demand will cause liquid stored in the accumulator tank to flow past temperature switch cooling said temperature switch and causing it to close and when system demand is sufficient to deplete liquid stored in accumulator tank and cause pressure to drop to preset pressure the pressure switch closes to start said pump.

2. A pressure-thermal control system regulating the on-off operation of a liquid centrifugal pump in response to external flow demand which comprises in a closed loop arrangement:

a. centrifugal pump having an inlet and outlet therein;

b. a check valve at the inlet side of said pump;

c. a pressure switch located at the outlet said switch being sensitive to a preset low pressure in the pump outlet to turn on the centrifugal pump;

d. a temperature-sensitive switch located at the outlet to sense the internal liquid temperature of said pump, set to a preset temperature to turn the centrifugal pump off;

e. a pressure accumulator tank located at the outlet of said pump directly above the temperature switch;

f. a recirculation line connecting the inlet with the outlet of said pump; one end of said recirculation line located immediately adjacent to the outlet of said pump and the other end of said recirculation line located between the check valve and inlet of said pump, said recirculation line consisting of said temperature switch and said accumulator tank, both said temperature switch and accumulator tank located immediately adjacent to the outlet of said pump with the accumulator tank located directly above said temperature switch.

* * * * *